US008567871B2

(12) United States Patent
Junker et al.

(10) Patent No.: US 8,567,871 B2
(45) Date of Patent: Oct. 29, 2013

(54) METHOD FOR AUTOMATICALLY CREATING A DEFINED FACE OPENING IN LONGWALL MINING OPERATIONS

(75) Inventors: Martin Junker, Rheinberg (DE); Armin Mozar, Hamm (DE)

(73) Assignee: RAG Aktiegesellschaft (DE)

( * ) Notice: Subject to any disclaimer, the term of this patent is extended or adjusted under 35 U.S.C. 154(b) by 190 days.

(21) Appl. No.: 12/918,477

(22) PCT Filed: Feb. 19, 2008

(86) PCT No.: PCT/EP2008/001266

§ 371 (c)(1),
(2), (4) Date: Aug. 19, 2010

(87) PCT Pub. No.: WO2009/103307

PCT Pub. Date: Aug. 27, 2009

(65) Prior Publication Data

US 2010/0327650 A1 Dec. 30, 2010

(51) Int. Cl.
*E21C 35/14* (2006.01)

(52) U.S. Cl.
USPC ..... 299/1.7

(58) Field of Classification Search
USPC ..... 299/1.05–1.9
See application file for complete search history.

(56) References Cited

U.S. PATENT DOCUMENTS

| | | | | |
|---|---|---|---|---|
| 4,181,360 A | | 1/1980 | Wilson | |
| 4,228,508 A | | 10/1980 | Benthaus | |
| 4,427,321 A | | 1/1984 | Weirich et al. | |
| 4,634,186 A | | 1/1987 | Pease | |
| 4,741,577 A | * | 5/1988 | Sato et al. | 299/1.6 |
| 4,755,084 A | | 7/1988 | Peters et al. | |
| 4,887,935 A | | 12/1989 | Koppers et al. | |
| 5,743,679 A | | 4/1998 | Gottschlich | |

FOREIGN PATENT DOCUMENTS

| | | | |
|---|---|---|---|
| DE | 3127702 A1 | * | 2/1983 |
| DE | 3620880 | | 6/1987 |
| GB | 2090896 | | 7/1982 |
| GB | 2092207 A | * | 8/1982 |

* cited by examiner

*Primary Examiner* — Sunil Singh
(74) *Attorney, Agent, or Firm* — Becker & Stachniak, P.C.; Robert Becker

(57) ABSTRACT

A method for automatically producing a defined face opening in a longwall mining operation, in underground coal mining, having a face conveyor, at least one extraction machine and hydraulic shield support frames. Inclination sensors are disposed on at least three of the four main components of each shield support frame, such as floor skid, gob shield, support connection rods and gob-side area of the top canopy. From ascertained inclination data, by comparison with base data defining a geometrical orientation of the components and a movement thereof during stepping, a respective shield height of the shield support frames perpendicular to a bed thereof is calculated. From further sensors on the extraction machine, a cutting height thereof is acquired as a face opening. In terms of a location-synchronous analysis, for possible adjustment purposes the cutting height is compared with the shield height when the shield support frame, which trails the extraction machine with a time delay, has reached the position to which relates that cutting height which was used in the comparison.

14 Claims, 5 Drawing Sheets

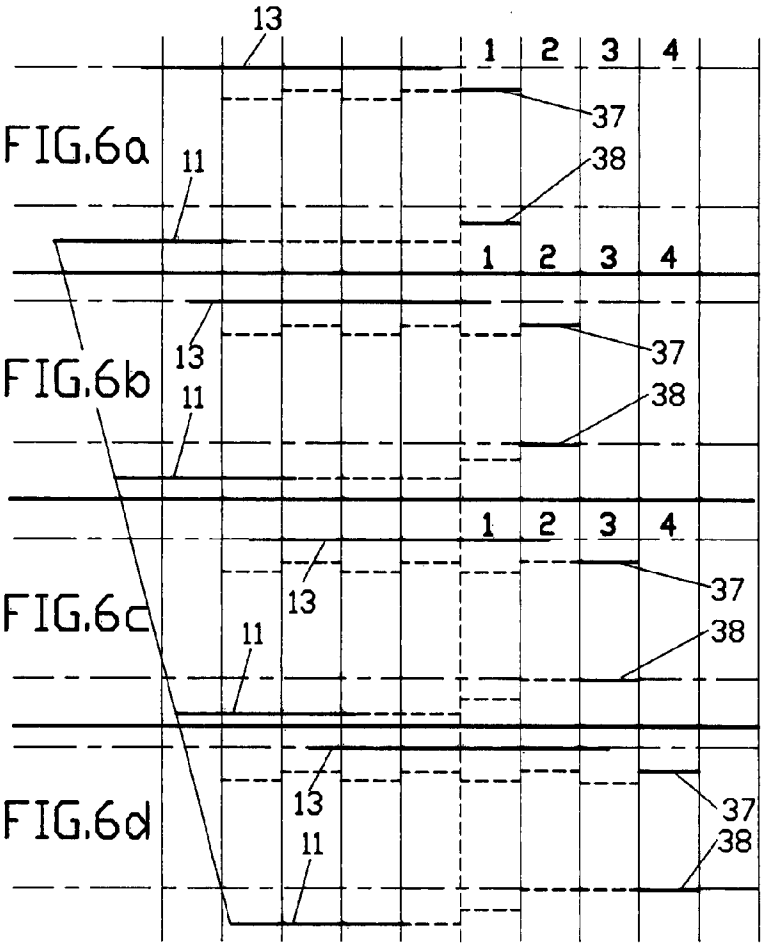
FIG.6a
FIG.6b
FIG.6c
FIG.6d
1
2
3
4
11
13
37
38
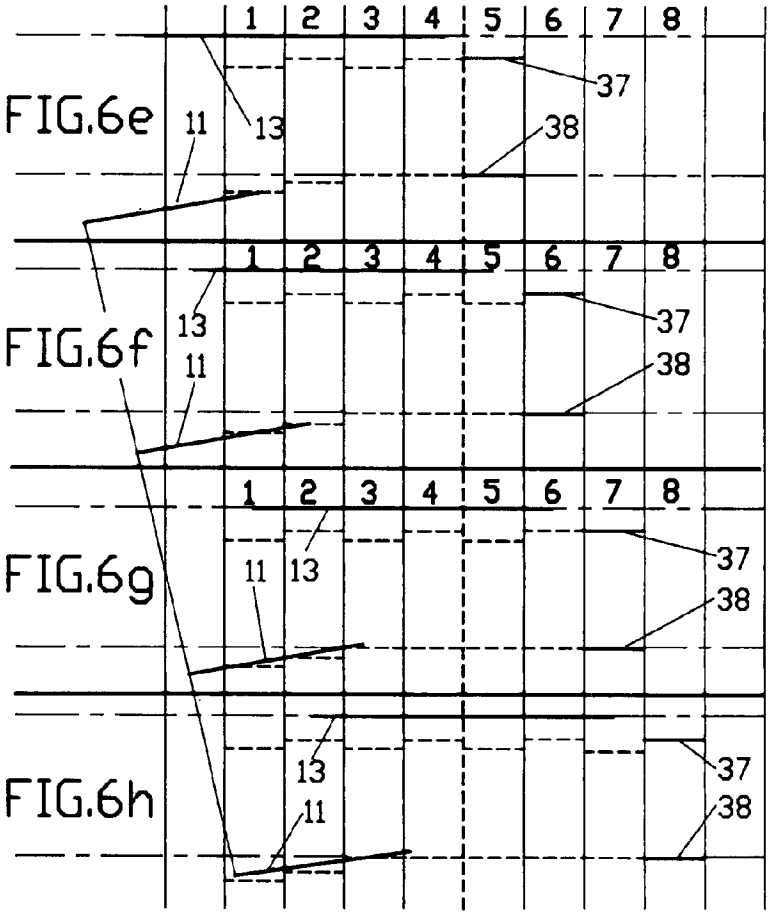
FIG.6e
FIG.6f
FIG.6g
FIG.6h
1
2
3
4
5
6
7
8
11
13
37
38

METHOD FOR AUTOMATICALLY CREATING A DEFINED FACE OPENING IN LONGWALL MINING OPERATIONS

BACKGROUND OF THE INVENTION

The instant application should be granted the priority date of Feb. 19, 2008, the filing date of the corresponding International patent application PCT/EP2008/001266.

The invention relates to a method for automatically creating a defined face opening in longwall mining operations, having a face conveyor, at least one extraction machine, and a hydraulic shield support, in underground coal mining.

One problem in the automatic control of longwall operations, both in the mining direction and also in the extraction direction of the extraction machine, is, inter alia, to produce a sufficiently large face opening, in order to ensure the passage of the longwall equipment without collisions between extraction machine and shield support frames, for example as the extraction machine travels past, on the one hand, and to keep the rock collapse during the extraction work as limited as possible, and accordingly to restrict the extraction work to the seam horizontal as much as possible, without also cutting excessive country rock, on the other hand. The mineral deposit data about seam thickness, level of footwall or of the overlying strata, and the presence of saddles and/or troughs both in the mining direction and also in the longitudinal direction of the longwall equipment, i.e., in the extraction direction of the extraction machine, which are essentially available before the extraction, are too imprecise to be able to support automated control of the extraction and support work thereon.

The invention is therefore based on the object of disclosing a method of the type cited at the beginning, using which automation of the extraction and support work is possible with respect to creating a defined face opening on the basis of the data to be acquired at the longwall equipment.

SUMMARY OF THE INVENTION

The achievement of this object results, including advantageous embodiments and refinements of the invention, from the content of the claims which are appended to this description.

In its basic idea, the invention provides a method, in particular for the cutting extraction using a disc shearer loader as the extraction machine, in which the inclination of the shield components in relation to the horizontal in the advancing direction is ascertained using inclination sensors attached to at least three of the four main components of each shield support frame, such as floor skid, gob shield, supporting connection rods, and gob-side area of the top canopy, and the particular height of the shield support frame perpendicular to the bed is calculated from the measured data in a computer unit by comparison with base data, which are stored therein and define the geometric orientation of the components and their movement during stepping, and in which furthermore the cutting height of the extraction machine is detected as the face opening using sensors attached to the extraction machine, the corresponding data sets being stored for each section of the longwall operation stepped through by an assigned shield support frame and the cutting height of the extraction machine being compared to the shield height of the shield support frame in terms of a location-synchronous analysis on a section of the longwall operation when the shield support frame, which trails with a time delay, reaches the position, to which the cutting height of the extraction machine on which the comparison with the shield height is based relates.

The advantage is connected to the present invention that, primarily on the basis of the shield height, which is to be ascertained with comparatively little effort, a parameter is available in sufficient precision and reliability for the longwall control. The other parameters used according to the invention comprise the detection of the cutting guidance of the extraction machine by establishing its absolute cutting height. Because the top canopy of the shield support frame first reaches the area exposed by the extraction machine as it travels past the relevant shield support frame with a time delay, i.e., with a so-called support delay of one to two support steps, the invention provides that the corresponding data sets for each section of the longwall operation stepped through by an assigned shield support frame are stored and compared in terms of a location-synchronous analysis. On the basis of this measure, a statement is possible about whether the cutting height exposed by the extraction machine also corresponds to the later shield height at this location, or whether possibly occurring strata collapse or occurring convergences result in deviations of the shield height upward or downward from the cutting height, which are to be taken into consideration the next time the extraction machine travels past, by a change or adaptation of its cutting height. This also applies correspondingly for the passage of troughs and/or saddles. The method according to the invention thus essentially uses the ascertained shield height in order to set up a control loop for controlling the extraction and support work with incorporation of the cutting height of the extraction machine, which results in automatic maintenance of a defined face opening upon its application. The shield height perpendicular to the bed, which is ascertained at the front edge of the top canopy between the upper edge of the top canopy and the lower edge of the skid, can expediently be used as an indicator for the longwall height. The shield height in the area of the shield prop is also suitable as a control variable for the height control of the particular shield support frame, because otherwise the relative angle between the top canopy and the floor skid in individual height adaptation phases results in strong height changes in relation to the canopy tip. It can thus be expedient to ascertain the shield height between top canopy and floor skid at arbitrary positions and to use the most advisable position for the particular method for the height control.

According to one exemplary embodiment of the invention, it can be provided that the stored data sets for cutting heights and shield heights are compared to one another in terms of a time-synchronous analysis for a selected section of the longwall operation at the same moment. Even if the relevant shield support frame has not yet reached the exposed area at the moment of the comparison, a time-synchronous analysis of the available data sets can contribute to the performance of prognoses with respect to the development of the face opening and of inclination changes on the shield support frames during the coming mining progress, so that on the basis of correspondingly established tendencies in the behavior of the face opening, the extraction and support work can be adapted early with respect to the maintenance of a predefined face opening.

Furthermore, in one exemplary embodiment the invention provides that a target height for the shield height of the shield support frames, which corresponds to the required face opening, is specified for an individual longwall operation on the basis of the mineral deposit data and the machine data applicable for the longwall equipment used, and in the event of deviations of the ascertained actual shield height from the target shield height, an automatic control of the cutting height of the extraction machine is performed to achieve the target shield height on the support. The target shield height applicable for the face opening results, on the one hand, from the support of the seam to be extracted, the extraction normally encompassing the visible material between a competent overlying strata and a competent footwall. This thus possibly also includes the extraction of a lubrication stratum visible between coal and competent overlying strata and also a panas layer visible between coal and competent footwall. On the other hand, the data of the shield support frames are to be considered in particular, above all their working range between a stand on the competent footwall and a support of the competent overlying strata, just so that the cutting height is not to be designed as greater than the working range of the shield support frames. The target cutting height is to be designed so that a passage of the extraction machine at the predefined cutting height is possible within the working range of the shield support frames without a collision. Because the competent overlying strata is not to be attacked by the extraction machine in operation, a planned footwall cut is also to be provided if necessary when establishing the cutting height, in order to be able to provide the required face opening even in the event of lesser seam thicknesses.

On the basis of the continuous monitoring of the actual shield height provided according to the invention, it can be checked from cut to cut of the extraction machine whether the face opening produced by the extraction machine is maintained corresponding to the target shield height, or whether deviations occur upward or downward. Corresponding to these deviations, it is possible to perform an automatic control of the extraction machine, either by changing the top cut on the leading disc, which is to leave the competent overlying strata untouched, however, or by changing the bottom cut on the trailing disc. The selection of the bottom cut dimension or optionally the top cut dimension is set in the case of various deviations of the actual shield height from the target shield height.

Thus, sudden changes in the inclination of the top canopy of individual shield support frames in limited sections of the longwall operation in the direction of a larger face opening indicate the presence of locally limited breakouts, and this can thus be differentiated from a possibly incorrectly set cutting height of the extraction height.

The comparison of the target shield height to the actual shield height can have the occurrence of convergence superimposed, which reduces the exposed face opening against the support action of the shield support used. Thus, it is provided according to one exemplary embodiment that if the shield height falls below the value for the cutting height, the occurring convergence is ascertained and the convergence is compensated for by elevating the bottom cut, for example. The influence of the convergence on the longwall height can thus be compensated for in a targeted manner. In a special embodiment of the invention, it is provided that in case of planned operating shutdowns, the face opening is enlarged by the amount of a convergence to be expected over the duration of the operating shutdown.

Because the development of the face opening over the mining progress is also a function of the relative inclination position in which the extraction machine having its discs stands in relation to the shield support frames, it is provided according to one exemplary embodiment of the invention that an inclination sensor is situated in each case on the face conveyor and/or on the extraction machine and the angle of inclination of face conveyor and extraction machine in the mining direction is ascertained. Situating an inclination sensor on the extraction machine is sufficient for this purpose. Although the extraction machine, which travels on the face conveyor and is guided thereon, forms a type of unit with the face conveyor, to improve the precision of the control, it can be expedient to also detect the inclination of the face conveyor via an inclination sensor situated thereon. If necessary, only situating an inclination sensor on the face conveyor is also sufficient for the purpose of the control.

The acquisition of the inclination behavior of the extraction machine in relation to the position of the shield support frame gives the possibility, in the event of relative angles of shield support frames and extraction machine to one another, of determining, on the one hand, a differential angle between the floor skid of the shield support frame and extraction machine and/or the face conveyor and, on the other hand, a differential angle between the top canopy of the shield support frame and the extraction machine and/or the face conveyor, and incorporating the particular differential angle in the calculation of the face opening to be produced by the extraction machine during the extraction. It can thus be expedient to acquire this skid angle in relation to the horizontal, which is measured in the mining direction via the inclination sensor provided on the floor skid of the shield support frame, and use it as a control variable, because the floor skid typically does not travel on the natural footwall, but rather along an exposed step contour of disc cut tracks. Upon setting of the shield support frame, in addition, sinking into the artificially produced footwall with a pressure spike occurring close to the skid tip frequently occurs because of the high surface pressure of the floor skid. The sinking of the floor skid does not occur parallel to the layer, but rather is stronger at the skid tip because of the pressure distribution on the floor skid, so that the floor skid executes a type of rotational movement. This, effect can be counteracted by the use of a so-called "base lift", using which the skid of an individual shield support frame can be raised in comparison to the top canopy in the context of the stepping action. Specifically, upon use of the base lift, the floor skid of the relevant shield support frame is raised before the stepping action, so that the skid may slide on the footwall and/or debris lying thereon. The floor skid can thus be prevented from digging in deeper and deeper. The base lift is also capable of advantageously orienting a shield support frame during the advance. In the cases in which the floor skid travels without significant problems on the footwall, a control of the shield support frame in consideration of the ascertained skid inclination is sufficient; ascertaining a skid angle is thus not required. In contrast, such a case occurs more rarely in the top canopy, as long as no collapse occurs at the overlying strata, because the top canopy typically travels along the natural horizontal of the overlying strata. Sinking of the top canopy into the overlying strata thus typically does not occur. In the case of occurring convergence, however, a height loss occurs on the shield support frame with accompanying angular movement of the top canopy, so that, as already described, relative positions between extraction machine and top canopy also permit conclusions about the face opening to be expected.

Furthermore, climbing of the extraction machine in the mining direction, which is to be detected via the inclination monitoring on the extraction machine, results in a reduction of the face opening with the danger of collisions of the extraction machine with the shield support frames, while plunging of the extraction machine in the mining direction results in an enlargement of the face opening, which exceeds the maximum working range of the shield support frames in certain circumstances. This is also to be taken into consideration by an adaptation of the cutting height on the extraction machine.

Such climbing or plunging of the extraction machine automatically occurs when passing through troughs and/or saddles which are pronounced in the mining direction. Thus, for example, the approach of a saddle is recognized by the established inclination change of the top canopy of the shield support frame pressing against the overlying strata. The height change can be calculated from the amount of the inclination change between two advance steps of the shield support in terms of a reduction of the height for each further stepping action of the relevant shield support frame. In order to keep the face opening at the set target level, and counteract the reduction of the face opening, a control movement is to be initiated to perform a bottom cut on the extraction machine. Subsequently, before passing over a saddle apex, an inclination change of the top canopy to the horizontal is recognizable. This is to be used for the purpose of controlling the cutting work in a timely manner using a reduction of the performed bottom cut, so that the target height of the face opening is also maintained when passing over the saddle. Corresponding control procedures, but with reversed signs, are also to be set when traveling through a trough, in which the same direction sequences prevail in principle.

The inclination sensors situated on the shield support frames also give a dimension for the inclination of the shield support frames laterally to the mining direction, because saddles and troughs may also be pronounced in the extraction direction of the extraction machine in the longwall course. Because the course of the overlying strata and footwall in the longitudinal direction of the longwall equipment may be derived from the lateral inclination of the shield support frames, the possibility exists of controlling the leading disc and the trailing disc of the extraction machine in the course of a continuous cutting guidance so that no undesired cut into the overlying strata or horizontal cut which exceeds the set amount occurs, so that unnecessary cutting of country rock or wasting coal or the occurrence of bottlenecks between extraction machine and shield support is avoided.

According to one exemplary embodiment of the invention, it is provided that acceleration sensors are used as the inclination sensors, which detect the angle of the acceleration sensor in space via the deviation from the Earth's gravity. The angle in relation to the vertical is thus determined physically, which is to be converted into the angle of inclination for the inclination of the shield components to the horizontal. It can be provided, to eliminate errors caused by the vibrations of the components used, that the measured values ascertained by the acceleration sensors are checked and corrected using a suitable damping method.

BRIEF DESCRIPTION OF THE DRAWINGS

Exemplary embodiments of the invention, which are described hereafter, are shown in the drawing. In the figures:

FIGS. 6*a-h* show a schematic view of a regulation to achieve a specified face opening starting from an initially excessive shield height.

DESCRIPTION OF SPECIFIC EMBODIMENTS

The foundations of the method according to the invention are explained in greater detail on the basis of the figures explained hereafter.

Figure 1:
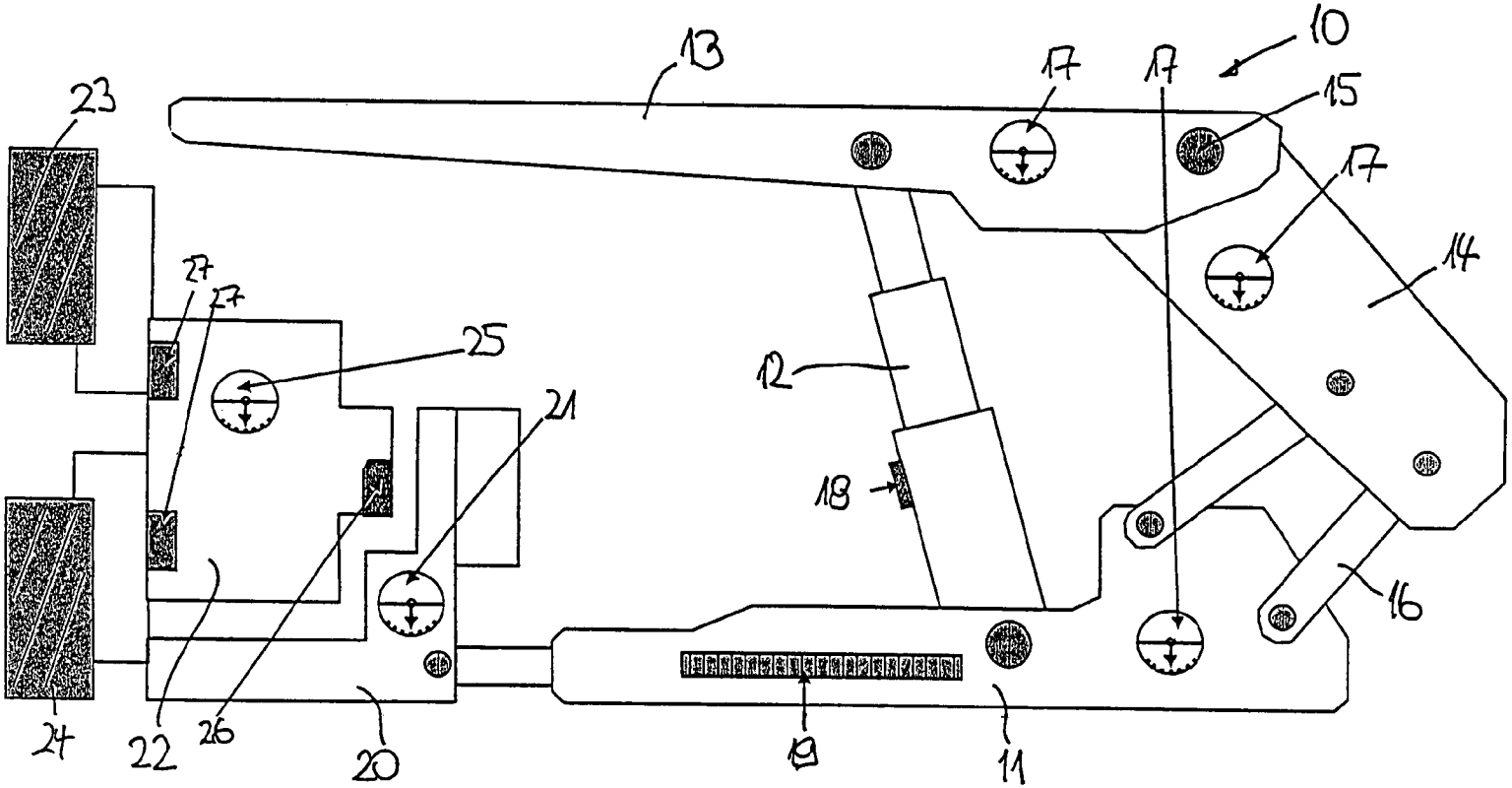
FIG. 1 shows a shield support frame having inclination sensors situated thereon in connection with a face conveyor and a disc shearer loader, used as the extraction machine, in a schematic side view.

The longwall equipment shown in FIG. 1 primarily comprises a shield support frame 10 having a floor skid 11, on which two props 12 are attached in a parallel configuration, of which only one prop is recognizable in FIG. 1, which carries a top canopy 13 on its upper end. While the top canopy 13 protrudes in the direction of the extraction machine (to be described hereafter) at its front (left) end, a gob shield 14 is linked on the rear (right) end of the top canopy 13 using a joint 15, the gob shield being supported by two supporting connection rods 16, which rest on the floor skid 11 in the side view. In the exemplary embodiment shown, three inclination sensors 17 are attached to the shield support frame 10, one inclination sensor 17 on the floor skid 11, one inclination sensor 17 in the rear end of the top canopy 13 in proximity to the joint 15, and one inclination sensor 17 on the gob shield 14. As is not shown in greater detail, an inclination sensor can also be provided on the fourth movable component of the shield support frame 10, the connection rods 16, three inclination sensors having to be installed of the four possible inclination sensors 17 in each case, in order to determine the position of the shield support frame in a working area using the inclination' values ascertained therefrom. The invention is thus not restricted to the concrete configuration of the inclination sensors shown in FIG. 1, but rather comprises all possible combinations of three inclination sensors on the four movable components of the shield support frame.

The shield support frame 10 shown in FIG. 1 is fastened to a face conveyor 20, which also has an inclination sensor 21, so that in general data with respect to the face conveyor location can also be obtained here in regard to the control of the longwall equipment. An extraction machine in the form of a disc shearer loader 22 having an upper disc 23 and a lower disc 24 is guided on the face conveyor 20, an inclination sensor 25 also being situated in the area of the disc shearer loader 22, as well as a sensor 26 for detecting the particular location of the disc shearer loader 22 in the longwall and reed bars 27 for measuring the cutting height of the disc shearer loader 22. The measuring equipment of the longwall equipment is supplemented by the configuration of sensors 18 on the props 12, using which the change of the height location of the top canopy 13 is possible by establishing the extension height of the prop 12. Furthermore, a distance measuring system 19 is integrated in the floor skid 11, using which the particular step stroke of the shield support frame 10 in relation to the face conveyor 20 can be established. As already noted, the configuration of the inclination sensor 21 on the face conveyor 20 is not absolutely necessary, if the inclination sensor 25 is set up on the disc shearer loader 22. In such a case, the inclination sensor 21 can additionally be provided for improving the measuring precision, however.

Figure 2:
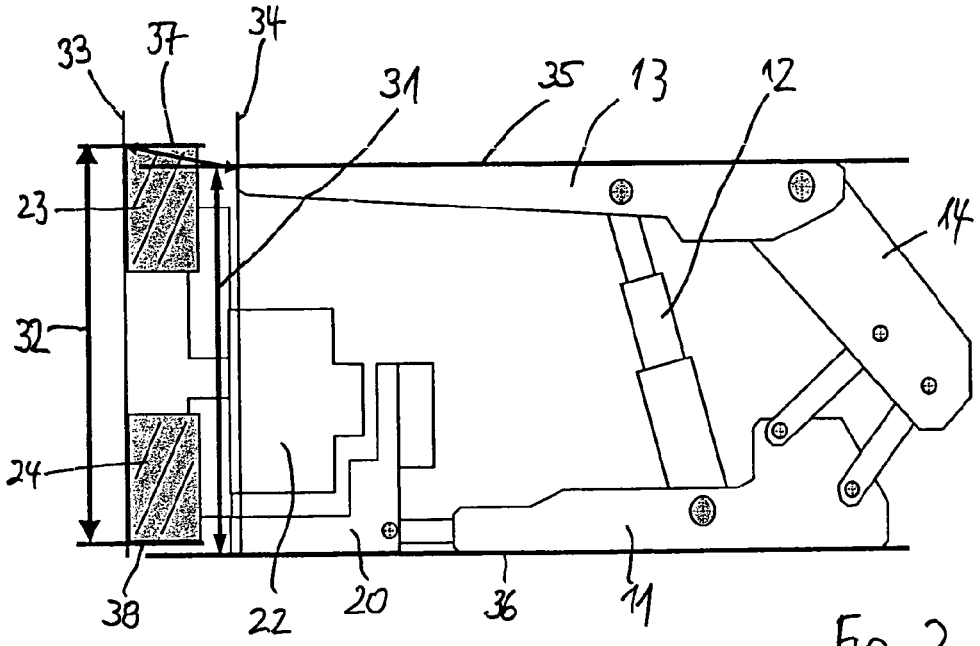
FIG. 2 shows the longwall equipment from FIG. 1 in the assignment in the case of a location-synchronous analysis.

As shown in FIG. 2, tie shield height 31 and the cutting height 32 of the extraction machine 22 are used for the control of the extraction and support work. The shield height 31 between the upper edge 35 of the top canopy 13 and the lower edge 36 of the floor skid 11 is ascertained on the basis of the values provided by the inclination sensors 17. The height ascertained at the tip of the top canopy 13 is used as the indicator for the longwall height. In particular the shield height in the area of the shield prop is suitable as the control variable for the height control of the shield support frame, because otherwise the relative angle between the top canopy and the floor skid in height adaptation phases results in excessively strong height changes with respect to the top canopy. Therefore, it is proposed that the shield height be ascertained at an arbitrary position between the top canopy and the floor skid in the area of the shield support frame and used for the most advisable position for the height control for the particular method.

The cutting height 32 is ascertained with the aid of the reed bars 27 between the upper edge 37 of the upper disc 23 and the lower edge 38 of the lower disc 24. As shown in FIG. 2, the determination of the cutting height 32 is performed at the first coordinate 33, while the shield height 31 is determined at the coordinate 34, which is set back in relation to the coordinate 33. This is because the shield support frame 10 is first moved to the coordinate 33 with a time delay after the passage of the extraction machine 22, so that the front edge of the top canopy 13, which is initially at the coordinate 34 upon determination of the cutting height 32, only reaches the coordinate 33 at a later moment. A location-synchronous analysis of the acquired data of this means that a comparison of the cutting height 32 and the shield height 31 only occurs when the shield support frame 10, which trails with the time delay, has reached the coordinate 33, to which the cutting height 32 of the extraction machine 22 forming the basis of the comparison to the cutting height 31 relates. A time-synchronous analysis proceeds from the particular current values for the shield height 31 and the cutting height 32 ascertained at the coordinate 33 or the coordinate 34 at the same moment.

Figure 3:
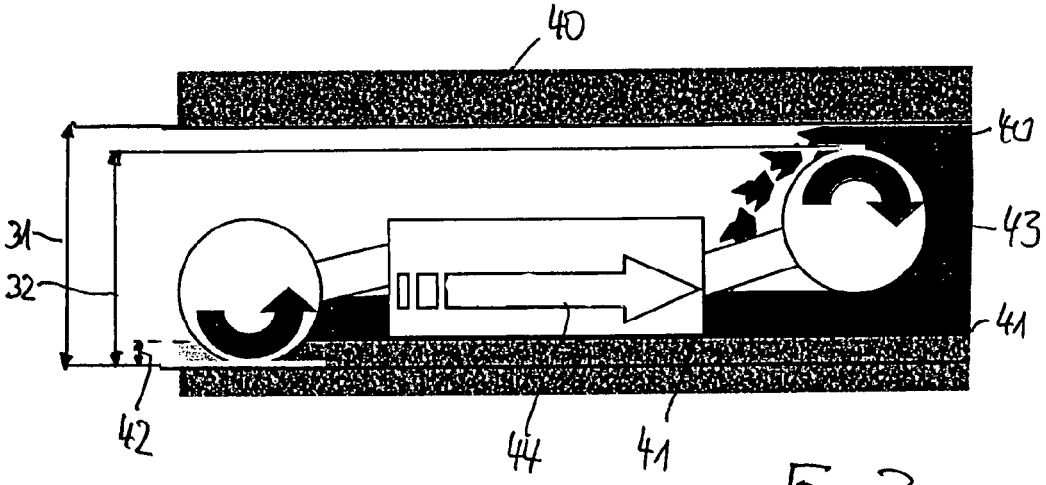
FIG. 3 shows the longwall equipment from FIG. 1 in operational use in a schematic view.

An operating situation as shown for exemplary purposes in FIG. 3 results during the operation of longwall equipment. A seam horizontal or layer 43 provided between an overlying strata 40 and a footwall 41 is extracted by the extraction machine 22, the cutting height 32 of the extraction machine 22, which is moving forward in the extraction direction 44, being set so that a footwall cut 42 is cut by the lower disc 24. The front upper disc 23 is set so that it leaves a narrow coal stratum below the overlying strata 40, which detaches independently from the overlying strata as a result of the cutting work. The set cutting height 32 is thus plotted in FIG. 3. It is shown that in this case the shield height 31 is set as greater than the cutting height 32, so that a collision-free passage of the extraction machine 22 at the shield support frames 10 is to be assumed.

Figure 4A:
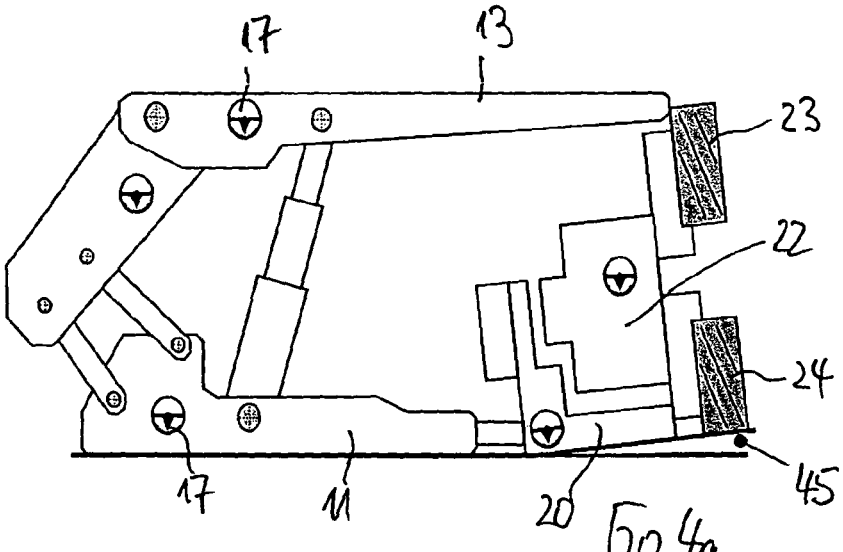
FIG. 4*a* shows the longwall equipment from FIG. 1 in the case of a climbing inclination of the extraction machine.
Figure 4B:
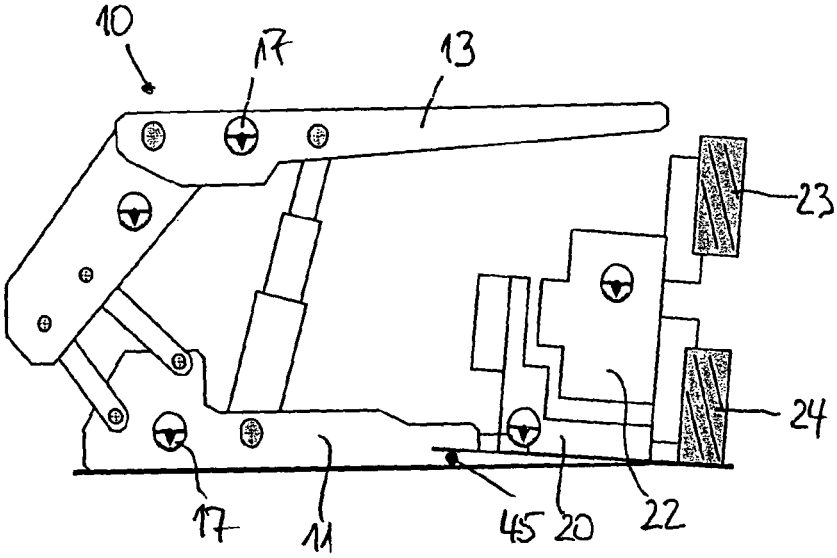
FIG. 4*b* shows the longwall equipment from FIG. 1 in the case of a plunging inclination of the extraction machine.

The conditions which result when the extraction machine 22 has a climbing inclination in relation to the shield support frame 10 (FIG. 4*a*), which is expressed in the formation of a differential angle 45 between the floor skid 11 and the lower disc 24 of the extraction machine 22, are shown in FIGS. 4*a* and 4*b*. It can be seen that in such a case the danger of a collision between the extraction machine 22 and the shield support frames 10 increases, and this risk can be taken into consideration by a change of the cutting height. This applies in a comparable manner for the situation shown in FIG. 4*b*, in which the extraction machine 22 has a plunging inclination. A corresponding differential angle 45 also results here, which can be determined on the basis of the positions of extraction machine 22 and shield support frame 10 detected by the inclination sensors 17 or 25 and 21, respectively, and the particular occurring differential angles 45 are to be considered accordingly in the longwall controller.

Figure 5A:
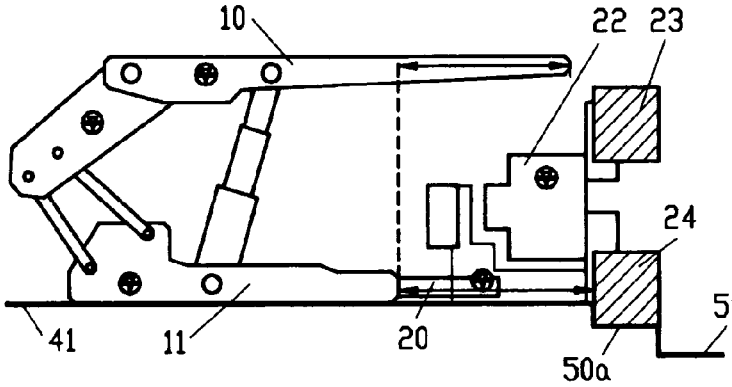
FIGS. 5*a-c* show a schematic vie of the time-delayed trailing of a shield support frame to the extraction of the extraction machine.
Figure 5B:
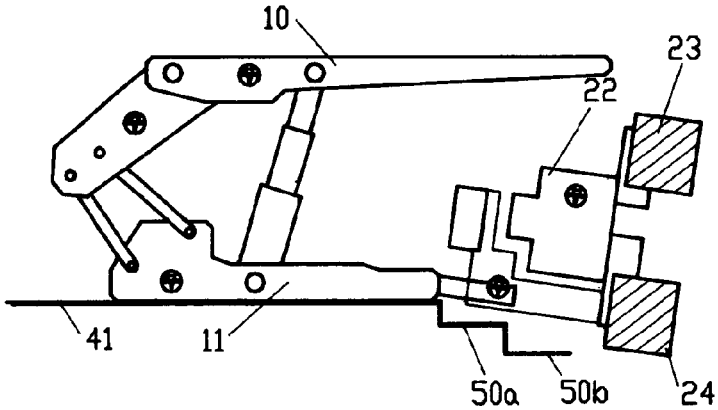
Figure 5C:
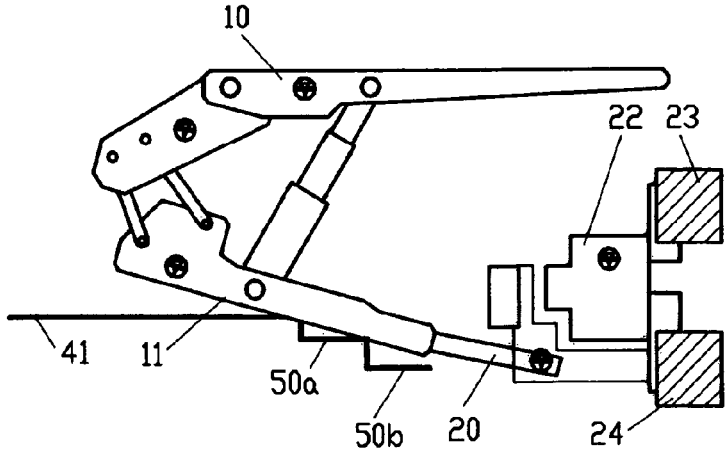

FIGS. 5*a* to 5*c* schematically show that the effect of a control movement, which is set on the extraction machine using a change of its cutting height or cutting location in the form of a bottom cut, for example, only has an effect on the shield support frame with a delay of multiple following steps of a shield support frame.

It is thus first obvious from FIG. 5*a* that the extraction machine 22 is to execute a directed downward movement via two cutting horizontals, identified by 50*a* and 50*b*, in relation to the footwall 41 on which the shield support frame 10 stands, in that two planned footwall cuts are to be performed. It is obvious from FIG. 5*b* that the shield support frame 10 still stands on the footwall 41 when the extraction machine 22 has already reached the new cutting horizontal 50*b* as the new footwall. Only the extraction machine 22 and the face conveyor 20 have thus initially reacted to the specified control pulses during the two extraction passes of the extraction machine 22. The shield support frame 10 only follows oriented to the plunging movement of the extraction machine 22 in the operating phase shown in FIG. 5*c*, FIGS. 5*b* and 5*c* indicating that the cutting height of the extraction machine 22 is already to be controlled during the lowering of extraction machine 22 and face conveyor 20 in relation to the original footwall 41 so that in the support steps following the operating phase shown in FIG. 5*c*, overshooting having excessively high shield height does not result. It is thus recognizable from FIG. 5*c* that the cutting height of the extraction machine 22 has been reduced in comparison to FIGS. 5*a* and 5*b*, in order to avoid an excessively large face opening. As long as the shield support frame 10 stands in the inclination position shown in FIG. 5*c* having a transition to the new footwall horizontal 50*b*, a corresponding overshoot of the face opening is to be accepted.

Fundamentally, the controller is to be able to be parameterized freely. The adaptation speed of the height regulation is to be set via a maximum step height, which can be parameterized freely. It is significant that during upward movements, the individual steps are not to be selected as excessively large, so that the face conveyor does not remain hanging on the step when moving and the face conveyor must be raised or a provided boom controller must tilt the face conveyor.

The sequence control in the case of a face opening regulation starting from a face opening, which is initially excessively high, will be described in greater detail on the basis of FIGS. 6*a* to 6*h*. The individual cutting fields of the extraction machine 22 in the mining direction are identified by progressing Arabic numerals 1 . . . 8. The top cutting line of the upper disc is indicated by the solid line 37, and the bottom cutting line of the lower disc is correspondingly indicated by the solid line 38. The top canopy 13 and the floor skid 11 of the associated shield support frame 10 are also indicated in the form of solid lines and identified by the associated reference numerals.

As first shown in FIG. 6*a*, the course of the cutting work up to this point is shown in the cutting fields indicated without numbers to the left of the first cutting field 1, in which the cutting line 38 of the lower disc specifies the plane for the sliding of the floor skid 11. It is recognizable that the top cutting line 37 varies slightly from cutting field to cutting field, but the top canopy 13 is significantly above the top cutting line 37, so that the shield height is dimensioned as greater than the cutting height. It can be assumed that the starting height for the shield height 31 is 3.0 in, while a target height for the face opening of only 2.30 m is to be maintained. In the cutting field 1 obvious from FIG. 6*a*, it is recognizable that to achieve the regulating target, a top cut for the lower disc is to be controlled and executed so that the bottom cutting line 38 is raised in relation to the starting state. The top cutting line 37 is unchanged. In the cutting field 2 shown in FIG. 6*b*, the system has caused the performance of a further top cut on the lower disc (section line 38). It may simultaneously be seen that the floor skid 11 has not yet changed its location, because the floor skid 11 still travels on the originally produced footwall level.

In the cutting field 3, which is decisive for FIG. 6*c*, the system has recognized that the now acquired cutting height corresponds to the target height for the face opening, so that a neutral cut having an unchanged cutting height is performed in the cutting field 3. This also applies correspondingly for the further cutting fields 4 to 8 shown in FIGS. 6*d* to 6*h*. With respect to the reaction of the shield support frame 10, it is to be noted that the floor skid 11 only reaches the step exposed in the cutting field 1 upon extraction of cutting field 5 and thus begins a climbing movement, which continues up to cutting field 8. In the cutting field 8, the front tip of the floor skid 11 has reached the new footwall level and first pivots to the target height upon passing through the closest cutting fields. The preceding sequence can be observed and controlled on the basis of the monitoring ct the inclination position of extraction machine and its cutting height and the inclination position of the components of the shield support frame 10.

A comparable movement sequence is executed if, starting from a shield height which is initially excessively low, the face opening is to be enlarged. The control also begins here with an enlargement of the cutting height of the extraction machine by adding a bottom cut at the lower disc, so that the floor skid of the shield support frame, with the top canopy kept at the same level, enters a plunging movement in the footwall cut specified by the extraction machine, until the new cutting level is also reached for the stepping movements of the shield support.

The features of the subject matter of this application disclosed in the above description, the claims, the abstract, and the drawing may be essential both individually and also in arbitrary combinations with one another for the implementation of the invention in its various embodiments.

The specification incorporates by reference the disclosure of International application PCT/EP2008/001266, filed Feb. 19, 2008.

The present invention is, of course, in no way restricted to the specific disclosure of the specification and drawings, but also encompasses any modifications within the scope of the attended claims.

The invention claimed is:

1. A method for automatically producing a defined face opening in a longwall mining operation in underground coal mining, including the steps of:

providing a face conveyor;

providing at least one extraction machine;

providing respective hydraulic shield support frames that include, as main components, a floor skid arrangement, a gob shield, a top canopy, and support connection rods;

disposing inclination sensors on at least three of the group consisting of said floor skid arrangement, said gob shield, said support connection rods, and a gob-side region of said top canopy; ascertaining from said inclination sensors an inclination of those components of said shield support frames provided with said inclination sensors relative to a horizontal;

in a computer, calculating from the ascertained inclination data, by a comparison with base data stored in the computer, and which base data defines a geometrical orientation of said shield support frame components as well as a movement thereof during a stepping process, a respective shield height of said shield support frames perpendicular to a bed of said shield support frames;

disposing further sensors on said at least one extraction machine;

acquiring from said further sensors a cutting height of said at least one extraction machine as a face opening;

storing corresponding data sets for each section of a longwall mining operation that an associated one of said shield support frames passes through; and in terms of a location-synchronous analysis on a section of the longwall mining operation, comparing, for possible adjustment purposes, said cutting height of said at least one extraction machine with said shield height of said shield support frame when said shield support frame, which trails said at least one extraction machine with a time delay, has reached the position to which relates that cutting height of said at least one extraction machine which was used in the last-mentioned comparing of said cutting height with said shield height.

2. A method according to claim 1, wherein said stored data sets for said cutting heights and said shield heights are compared to one another, in terms of a time-synchronous analysis for a section of the longwall mining operation, at the same moment.

3. A method according to claim 1, which includes the further steps of specifying a target height for said shield height of said shield support frame for an individual longwall operation on the basis of mineral deposit data and machine data of the longwall equipment being employed, and, in the event of deviations of the ascertained actual shield height from the target shield height, carrying out an automatic control of said cutting height of said at least one extraction machine to set the target shield height.

4. A method according to claim 3, which includes the further step of establishing said cutting height of said at least one extraction machine by changing a top cut of a disc of said at least one extraction machine.

5. A method according to claim 3, which includes the further step of setting said cutting height of said at least one extraction machine by changing a bottom cut of a disc of said at least one extraction machine.

6. A method according to claim 1, which, if said shield height falls below value for said cutting height, includes the further steps of ascertaining the convergence that occurs, and compensating for said convergence by increasing a bottom cut.

7. A method according to claim 6, which, in the event of planned operating shutdowns, includes the further step of enlarging the face opening by the amount of a convergence that is to be expected over the duration of the operating shutdown.

8. A method according to claim 1, which includes the steps of disposing a respective inclination sensor on at least one of said face conveyor and said at least one extraction machine, and ascertaining an angle of inclination of said face conveyor and said at least one extraction machine in a direction of mining.

9. A method according to claim 8, which includes the further steps of calculating a differential angle between said floor skid arrangement of said shield support frame and said face conveyor or said at least one extraction machine on the basis of the angle of inclination of said face conveyor and said at least one extraction machine measured in the direction of mining, and incorporating this differential angle in the calculation of the face opening that is to be cut by said at least one extraction machine.

10. A method according to claim 8, which includes the further steps of calculating a differential angle between said top canopy of said shield support frame and said face conveyor or said at least one extraction machine on the basis of the angle of inclination of at least one of said face conveyor and said at least one extraction machine measured in the direction of mining, and incorporating this differential angle in the calculation of the face opening that is to be cut by said at least one extraction machine.

11. A method according to claim 1, which includes the further steps of determining the course of troughs and/or saddles in a direction of mining via the ascertainment of the inclination of said top canopy of said shield support frame in the direction of mining; predetermining a change of the face opening via determined changes of the inclination of said top canopy over a predefined period of time and accordingly setting a control of the cutting work of said at least one extraction machine.

12. A method according to claim 1, which includes the further steps of determining a course of troughs and/or saddles in a direction of extraction of said at least one extraction machine via the ascertainment of the inclination of individual ones of said shield support frames transverse to the direction of mining, and controlling a cutting behavior of said at least one extraction machine in such a way that discs of said at least one extraction machine follow the determined course of the troughs and/or saddles.

13. A method according to claim 1, which includes the further step of using acceleration sensors as said inclination sensors, wherein said acceleration sensors detect the angular position of said acceleration sensors in space via a deviation from acceleration due to gravity.

14. A method according to claim 13, which includes the further step of checking and correcting the measured values ascertained by said acceleration sensors by means of a suitable damping method to eliminate errors caused by vibrations of the component being utilized.

* * * * *